US007093950B2

(12) United States Patent
Kui

(10) Patent No.: US 7,093,950 B2
(45) Date of Patent: Aug. 22, 2006

(54) ILLUMINATION PEN

(76) Inventor: Weiliang Kui, Ningbo Chenglu Stationery, Ningbo, Bei Lun, Xiao Gang (CN)

( * ) Notice: Subject to any disclaimer, the term of this patent is extended or adjusted under 35 U.S.C. 154(b) by 130 days.

(21) Appl. No.: 10/916,834

(22) Filed: Aug. 11, 2004

(65) Prior Publication Data

US 2006/0034067 A1 Feb. 16, 2006

(51) Int. Cl.
*B43K 29/10* (2006.01)

(52) U.S. Cl. ..... 362/118; 362/579

(58) Field of Classification Search ..... 362/118, 362/579

See application file for complete search history.

(56) References Cited

U.S. PATENT DOCUMENTS 3,502,859 A * 3/1970 Kochan ..... 362/579
5,544,967 A * 8/1996 Yao ..... 401/195
5,730,539 A * 3/1998 Chabria ..... 401/195
6,099,185 A * 8/2000 Huang et al. ..... 401/195
6,623,136 B1 * 9/2003 Kuo ..... 362/118
6,955,445 B1 * 10/2005 Omowale ..... 362/118
2004/0161287 A1 * 8/2004 Yu ..... 401/195
2005/0036336 A1 * 2/2005 Yang ..... 362/579

* cited by examiner

*Primary Examiner*—Ali Alavi
*Assistant Examiner*—Hargobind S. Sawhney

(57) ABSTRACT

An illumination pen includes a hollow pen holder having a receiving cavity and a lower light transmissible body, a writer device and an actuator. The writer device includes a pen core, an illumination device including a battery and an illuminator. The actuator includes a rotor rotatably provided on the pen holder, and a driving member including a conductive arm and a pushing arm. When the rotor is rotated at a clockwise direction, the conductive arm is driven to electrically connect with the illuminator so as to light it up, when the rotor is rotated at a counter-clockwise direction, the pushing arm is driven towards the illuminator to move the writing tip of the pen core out of the bottom opening of the pen holder.

20 Claims, 6 Drawing Sheets

ILLUMINATION PEN

BACKGROUND OF THE PRESENT INVENTION

1. Field of Invention

The present invention relates to a pen, and more particularly to an illumination pen which are actuated by rotation of a rotor mounted on a pen holder to selectively switch on illumination device for providing a light effect.

2. Description of Related Arts

A conventional pen typically comprises a pen body and a pen core having a main portion received in the pen body, and a pen pointer downwardly extended out therefrom to controllably release ink for writing. A more sophisticated embodiment of conventional pens is that the pen further comprises an actuation device for selectively and slidably pushing the pen core out from the pen body for writing, and pulling the pen core to normally receive into the pen body while it is not in use.

There exist a handful of conventional illumination pens which can provide illumination while the user is writing. This feature is absolutely advantageous, in that in some circumstances, the user may still write in a generally dark environment, such as taking an urgent note while watching a movie.

Conventional pens with such as illumination function usually require two separate actions for turning on the illumination and for actuating the pen for writing respectively. Thus, it is not difficult to imagine that those pens, though useful in function, is inconvenient to operate in practice.

As an attempt to avoid this inconvenience, there exists another category of illumination pens in which the user is simply required to press one single button for actuating either or both of the illumination function and for writing. While this category of illumination pens reduce a certain degree of inconvenience as compared with the above-mentioned category, unfortunately, this more recent development creates other inconvenience, the most obvious being the difficulty in ascertaining what would happen when the user presses to actuate the pen because it usually adopts a sequential operation approach for the actuation of the illumination function.

For instances, an operation of the pen may be as follows: when the user first presses to actuate the pen, the pen core would be pushed out of the pen body for writing without illumination thereof. The second time the user presses the pen, the pen core would be pulled back to receive in the pen body. When the user presses the pen the third time, the illumination would be turned on and that the pen core would be pushed out again for writing. Finally, when the user finishes writing, he/she needs to press the pen for the fourth time and the illumination would be turned off, and that the pen core would be pulled back to normally receive in the pen body.

One can immediately appreciate that if the user wants writing with illumination, he/she may have to press the pen for three times. But the user never knows, since it is when he/she has pressed the pen then he/she could know that in which stage or status the pen are. As a result, in practice, this more recent development of illumination pens is still far from satisfactory.

SUMMARY OF THE PRESENT INVENTION

A main object of the present invention is to provide an illumination pen which is actuated by two separate and opposite rotation of a rotor mounted on a pen holder so as to actuate the pen for mere writing and writing with illumination. In other words, the user of the present invention can be sure with and capable of freely choosing the operation of the illumination pen.

Another object of the present invention is to provide an illumination pen wherein a single rotational motion of the actuator is adapted to actuate a linear motion of a pen core and an illumination of the illumination pen. Thus, difficulties in sequential actuation as employed in conventional illumination pen can be avoided.

Another object of the present invention is to provide an illumination pen which is simple in structure, self-contained, convenient and flexible to use, and does not involve any expensive components so that the manufacturing cost and the ultimate selling price can be minimized.

Another object of the present invention is to provide an illumination pen which can be embodied as a wide variety of pens, such as a mechanical pen, a ball pen, or even a drawing pen.

Accordingly, in order to accomplish the above objects, the present invention provides an illumination pen, comprising:

a hollow pen holder having a receiving cavity, a lower light transmissible body, and a bottom opening communicating the receiving opening;

a writer device, which comprises:

a pen core, having a writing tip, disposed in the receiving cavity of the pen holder;

an illumination device comprising a replaceable battery supported in the receiving cavity and at least an illuminator mounted in the receiving cavity; and an actuator, which comprises a rotor rotatably mounted at the pen holder; and a driving member, comprising a conductive arm and a pushing arm, driven by the rotor to move the pen core from a normal unemployed position to an operation position, wherein at the operation position, the rotor is rotated to drive the driving member to push the writing tip out of the pen holder at the bottom opening thereof, and at the unemployed position, the writing tip of the pen core is received within the receiving cavity;

wherein the conductive arm functions as a switch and is arranged in such a manner that when the rotor is rotated at a clockwise direction from the unemployed position to move the driving member downwardly, the conductive arm is driven to electrically connect with the illuminator, such that the illuminator generates a light effect within the light transmissible body to an exterior thereof, so as to move the writing tip of the pen core out of the bottom opening of the pen holder; and wherein the rotor is rotated at a counter-clockwise direction from the unemployed position to move the driving member downwardly, the pushing arm is driven towards the illuminator to move the writing tip of the pen core out of the bottom opening of the pen holder.

These and other objectives, features, and advantages of the present invention will become apparent from the following detailed description, the accompanying drawings, and the appended claims.

DETAILED DESCRIPTION OF THE PREFERRED EMBODIMENT

Figure 1:
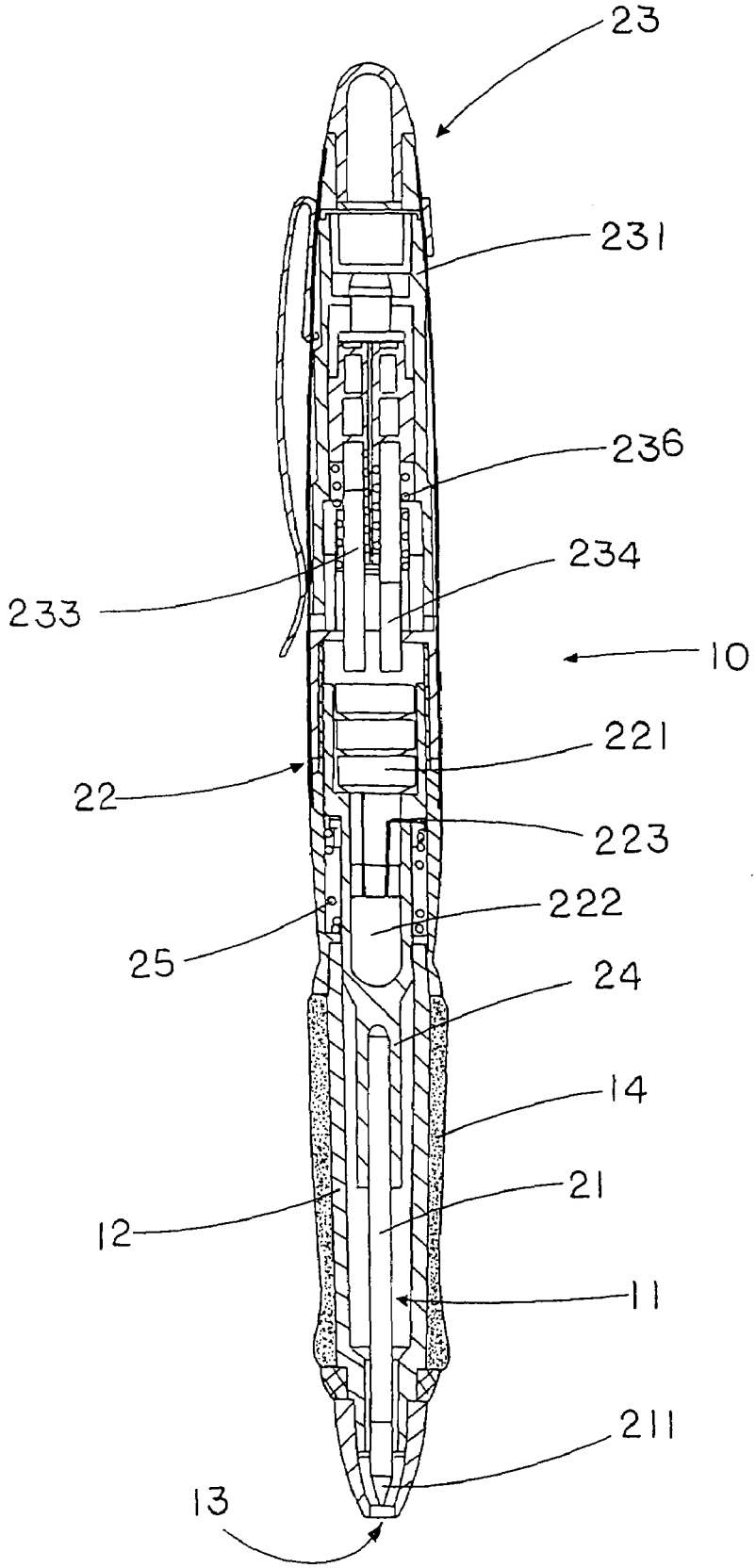
FIG. 1 is a sectional side view of an illumination pen according to a preferred embodiment of the present invention.

Referring to FIG. 1 of the drawings, an illumination pen according to a preferred embodiment of the present invention is illustrated, in which the illumination pen comprises a hollow pen holder 10, and a writer device.

The hollow pen holder 10 has a receiving cavity 11 formed therein, a lower light transmissible body 12, and a bottom opening 13 communicating with the receiving cavity 11. The pen holder 10 is preferably made of rigid materials such as metallic material or rigid plastic materials for securely supporting the writer device wherein a user is adapted to grab the pen holder for writing.

The writer device comprises a pen core 21, an illumination device 22, and an actuator 23. The pen core 21, which has a writing tip 211 formed at a bottom end thereof, is movably disposed in the receiving cavity 11. According to the preferred embodiment, the pen core 21 is filled with a predetermined kind of ink which is controllably released via the writing tip 211 when the user is in writing.

The illumination device 22 comprises at least one replaceable battery 221 supported in the receiving cavity 11 of the pen holder 10, and at least one illuminator 222, which is preferably embodied as a LED illuminator, mounted in the receiving cavity 11 for providing illumination within the light transmissible body 12 of the pen holder 10 when actuated.

The actuator 23 comprises a rotor 231 rotatably provided on the pen holder 10, and a driving member 232. The driving member 232 comprises a conductive arm 233 and a pushing arm 234, and is driven by the rotor 231 to move the pen core 21 from a normal unemployed position to an operation position, wherein at the operation position, the rotor 231 is rotated to drive the driving member 232 to push the writing tip 211 out of the pen holder 10 via the bottom opening 13 thereof, so that the user of the present invention is able to write. In contrast, when the pen core 21 is in the unemployed position, the writing tip 211 thereof is pulled to receive within the receiving cavity 11 so that it is substantially protected from accidental damage in the receiving cavity 11.

According to the preferred embodiment, the conductive arm 233 functions as a switch and is arranged in such a manner that when the rotor 231 is rotated in a clockwise direction from the unemployed position to move the driving member 232 downwardly, the conductive arm 233 is driven to electrically connect with the illuminator 222, such that the illuminator 222 generates a light effect within the light transmissible body to an exterior thereof, so as to move the writing tip 211 of the pen core 21 out of the bottom opening 13 thereof.

Conversely, when the rotor 231 is rotated at a counter-clockwise direction from the unemployed position to move the driving member 232 downwardly, the pushing arm 234 is driven towards the illuminator 222 to move the writing tip 211 of the pen core 21 out of the bottom opening 13. In other words, the writing tip 211 is pushed out for writing while the illuminator 222 is not actuated for illumination. Thus by rotating the rotor 231 in a predetermined direction, the user is able to easily and conveniently control the illumination of the illumination pen by rotating the rotor 231 in a suitable direction.

Figure 2:
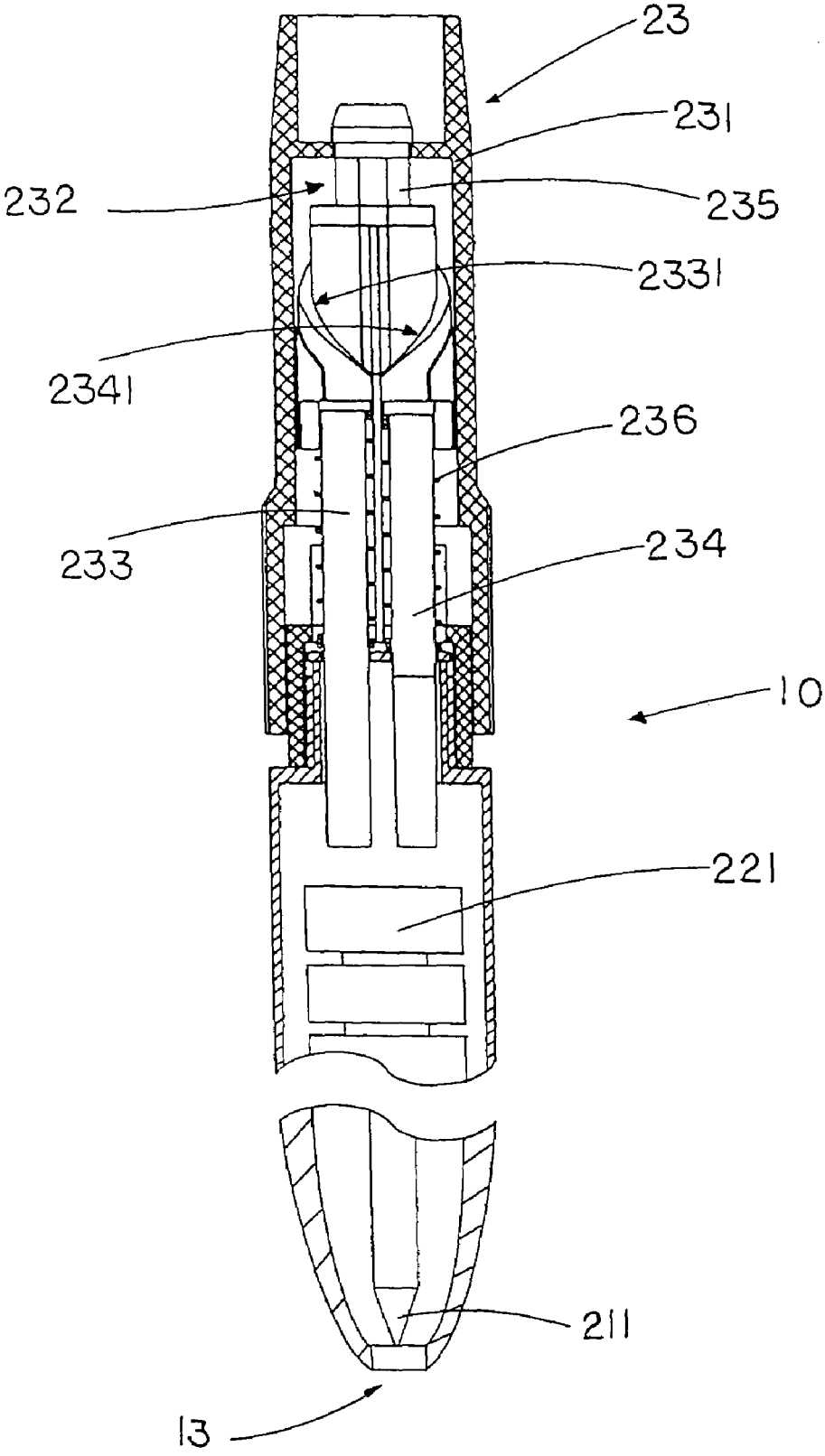
FIG. 2 is a sectional side view of the actuator according to the above preferred embodiment of the present invention.

Referring to FIG. 2 of the drawings, the driving member 232 further comprises an elongated supporting member 235 which is rotatably supported within the pen holder 10 and is driven to be rotated by the rotor 231, wherein the conductive arm 233 and the pushing arm 234 are slidably mounted at two sides of the supporting member 235 such that the conductive arm 233 and the pushing arm 234 are guided to slide towards the pen core 21. In other words, the rotor 231 is rotatably mounted about the supporting member 235 for rotating with respect to the pen holder 10.

Moreover, the rotor 231, which is a hollow member, further has a guiding cavity formed therein, and has a vertical guiding ridge 2311 formed on an inner side thereof within the guiding cavity at a position between the conductive arm 233 and the pushing arm 234, wherein the guiding ridge 2311 is selectively engaged with one of the conductive arm 233 and the pushing arm 234 when the rotor 231 is rotated, so as to drive one of the conductive arm 233 and the pushing arm 234 downwardly to move the writing tip 221 of the pen core 21 out of the bottom opening 13 of the pen holder 10. In other words, when the rotor 231 is rotating, the guiding ridge 2311 guides the conductive arm 233 and the pushing arm 234 of the driving member 232 downwardly to drive the pen core 21 moving between the normal unemployed position and the operation position. In other words, the driving member 232 is received in the guiding cavity and substantially guided by the guiding ridge 2311.

Figure 3A:
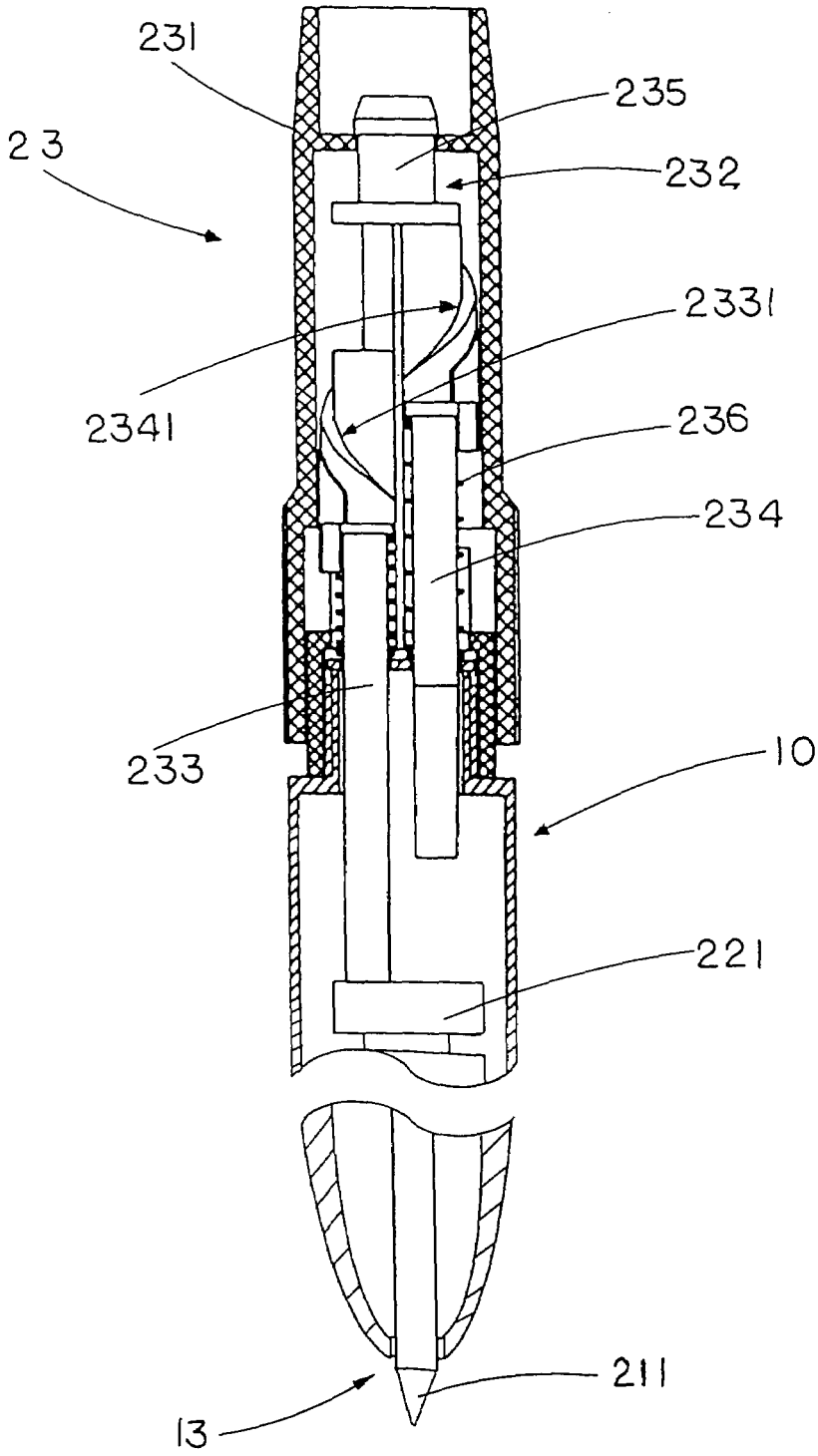
FIGS. 3A and 3B are schematic diagrams of the actuator according to the above preferred embodiment of the present invention, illustrating that rotor is rotating in a clockwise and a counter-clockwise directions respectively.

Specifically, the conductive arm 233 and the pushing arm 234 are slidably mounted on the supporting member 235, and have first and second slanted tracks 2331, 2341 inclinedly and peripherally formed thereon respectively to communicate with a bottom end of the guiding ridge 2311 of the rotor 231 in such a manner that when the rotor 231 is rotated in the clockwise direction, the guiding ridge 2311 is rotated to slidably engage with and travel upwardly along the first slanted track 2331 so as to push the conductive arm 233 downward for pushing the pen core 21 moving from the normal unemployed position to the operation position while the conductive arm 233 is electrically connecting with the illumination device 22 to light up the illuminator 222, as shown in FIG. 3A of the drawings.

Figure 3B:
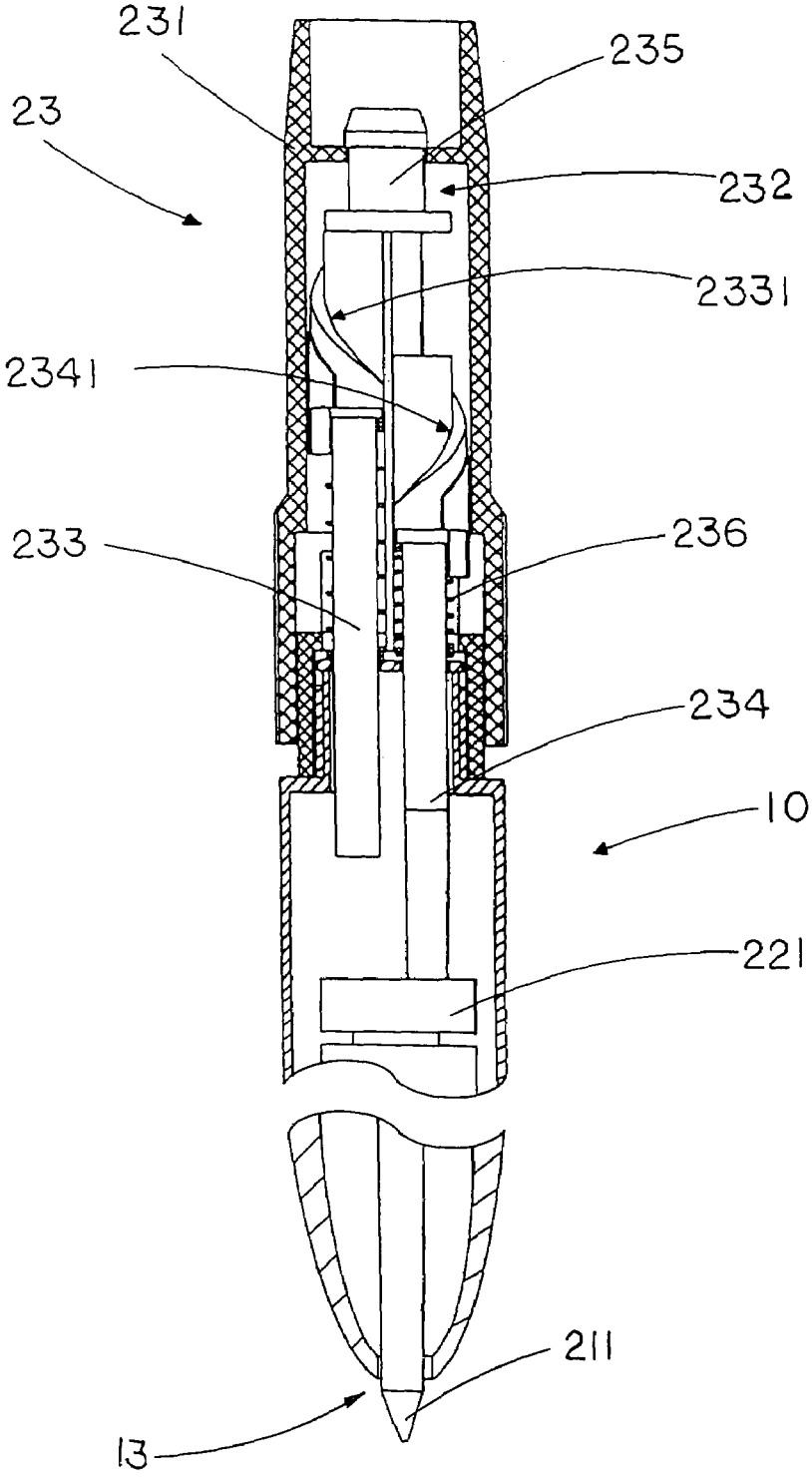

Similarly, when the rotor 231 is rotated in the counter-clockwise direction, the guiding ridge 2311 is rotated to slidably engage with and travel upwardly along the second slanted track 2341 so as to push the pushing arm 234 downward for pushing the pen core 21 moving from the normal unemployed position to the operation position while the illuminator is not to be electrically connected, as shown in FIG. 3B of the drawings.

In other words, the first and the second slanted tracks 2331, 2341 are upwardly inclined from the bottom end of the guiding ridge 2311 so that when it is rotated, it will either, depending on the direction of rotation, travel upwardly along the first or the second slanted track 2331, 2341, and push the conductive arm 233 or the pushing arm 234 downwardly to push the pen core 21 into the operative position. Thus, one can observe that a rotation of the rotor 231 is transformed into a linear motion of the driving member 232 by the first and the second slanted tracks 2331, 2341.

Figure 4A:
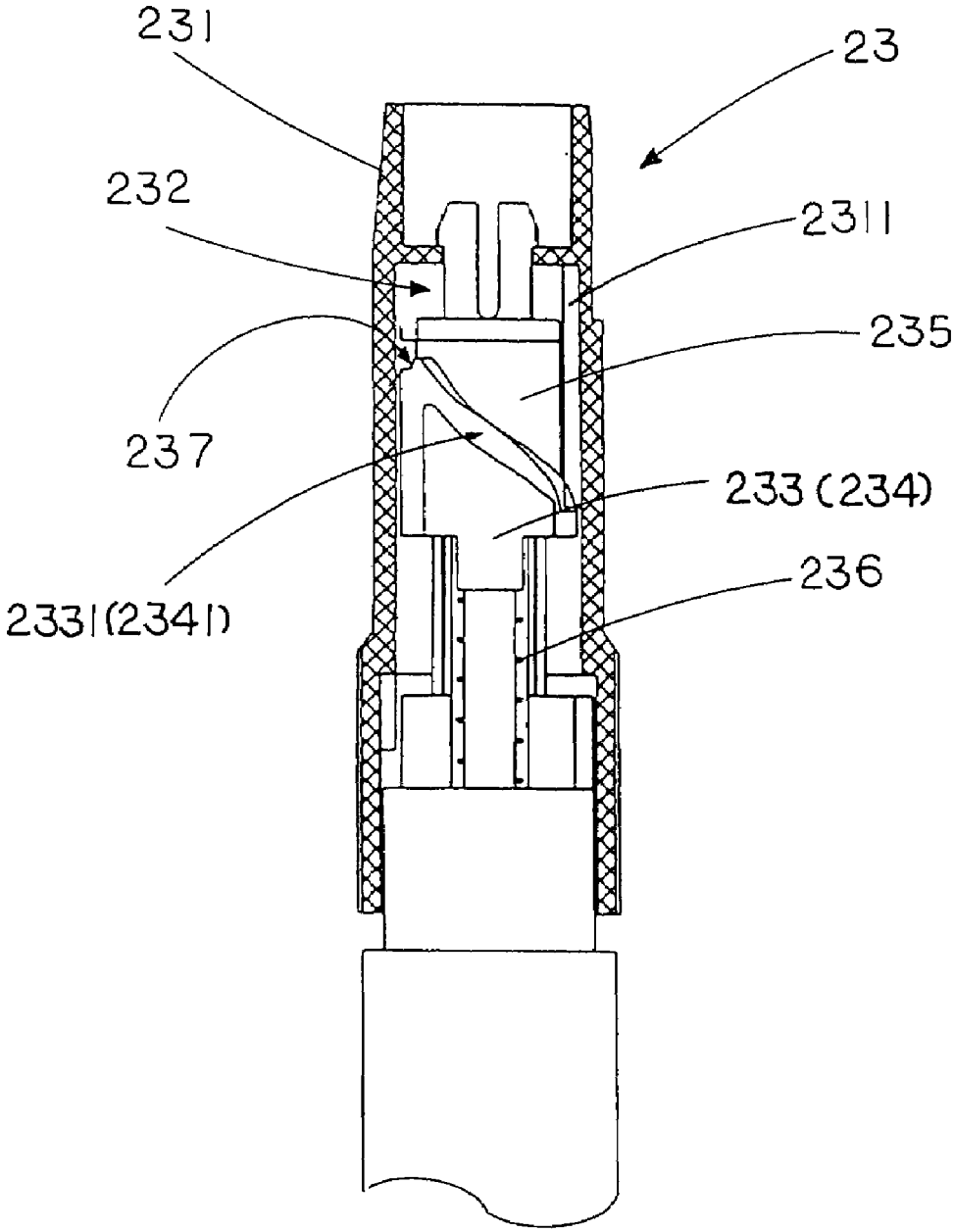
FIGS. 4A and 4B are section views of the driving member according to the above preferred embodiment of the present invention.
Figure 4B:
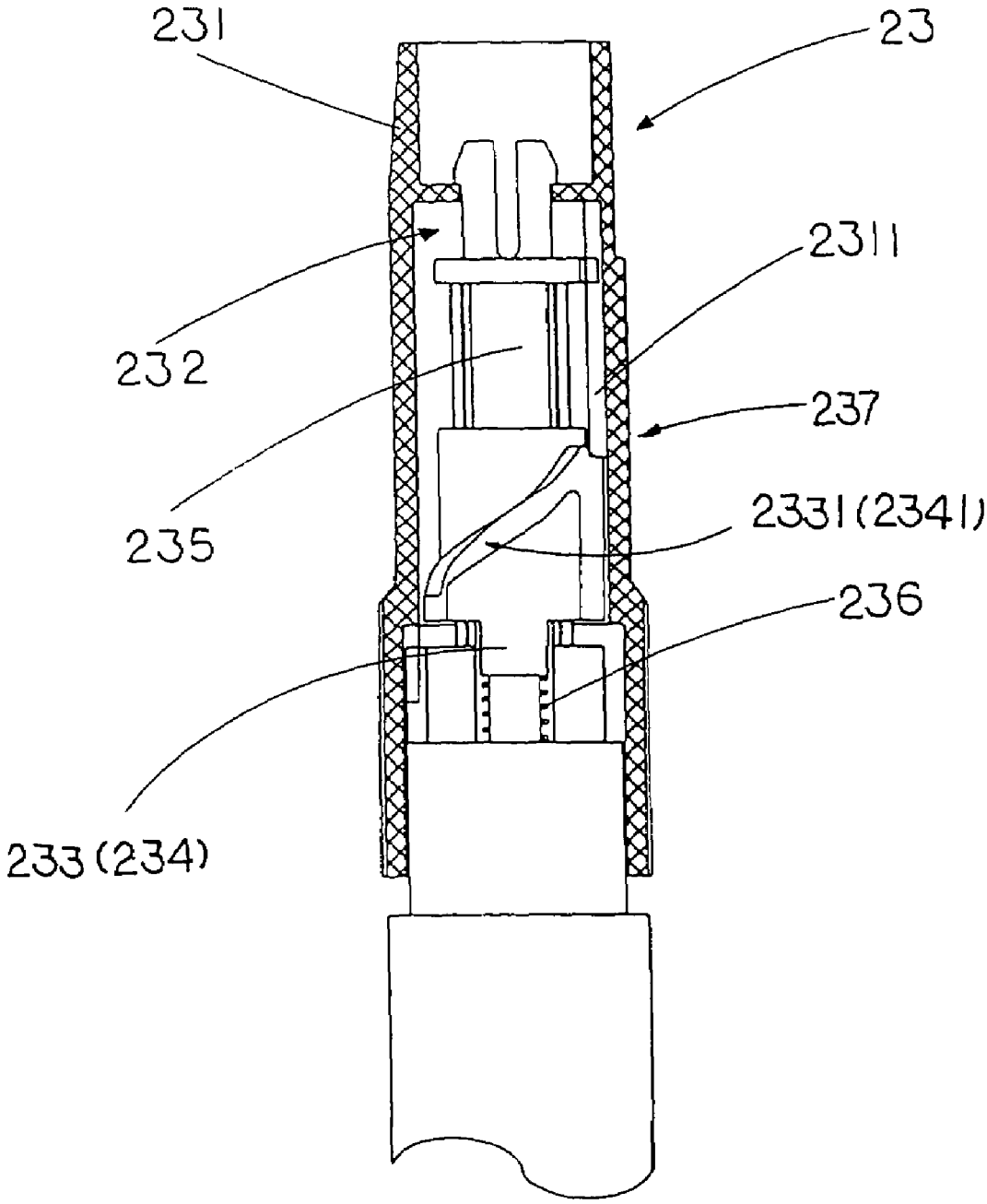

Referring to FIGS. 4A and 4B of the drawings, the driving member 232 further comprises two resilient elements 236 mounted on the conductive arm 233 and the pushing arm 234 for normally exerting an upward pushing force to the conductive arm 233 and the pushing arm 234 respectively so as to normally retain the guiding ridge 2311 resting on a bottom end of the inclined first and the second slanted tracks 2331, 2341. In other words, the resilient elements 236 normally push the driving member 232 disengaging with the pen core 21.

As shown in FIG. 4A, the driving member 232 further has two retaining stoppers 237 formed on top of the conductive arm 233 and the pushing arm 234 respectively in such a manner that when the rotor 231 is rotated, the bottom end of the guiding ridge 2311 travels along upward one of the slanted tracks 2331, 2341 to eventually engage with the respective retaining stopper 237, as shown in FIG. 4B. Because of the normal upward force exerted by the respective resilient element 236, when the bottom end of the guiding ridge 2311 engages with the retaining stopper 237, the conductive arm 233 or the pushing arm 234 will bias against the guiding ridge 2311 so as to retain the driving member 232 in position. Accordingly, in order to release the biasing force, the user may simply need to slightly rotate the rotor 231 aside in the opposite direction so as to disengage the guiding ridge 2311 from the respective retaining stopper 237.

Accordingly, the two retaining stoppers 237 are two indentions indented on top ends of the first and the second slanted tracks 2331, 2341 respectively such that the bottom end of the guiding ridge 2311 slides along the respective first and the second slanted tracks 2331, 2341 until the bottom end of the guiding ridge 2311 is stopped at the respective retaining stopper 237 to retain the conductive arm 233 and the pushing arm 234 in a downward moving manner.

The replaceable battery 221 is supported within the receiving cavity 11 of the pen holder 10 at a position between the pen core 21 and the driving member 232 such that when the conductive arm 233 is driven downwardly, a bottom end of the conductive arm 233 is electrically contacted with the replaceable battery 221 so as to electrically connect the replaceable battery 221 with the illuminator 222. It is worth to mention that the conductive arm 233 is made of conductive material adapted to form the closed circuit of the illuminator 222 with the replaceable battery 221. In addition, the pushing arm 234 is made of insulating material, such as plastic, such that when the pushing arm is driven downwardly until a bottom end of the pushing arm 234 contacts with the replaceable battery 221, no electrical connection is formed between the replaceable battery 221 and the illuminator 222. Therefore, when either the conductive arm 233 or the pushing arm 234 is pushed downwardly, the pen core 21 is downwardly pushed at a position at the writing tip 211 of the pen holder 10 is pushed out of the bottom opening 13 of the pen holder 10. However, only when the conductive arm 233 is pushed downwardly, the illuminator 222 is electrically connected with the replaceable battery 221 for providing the light effect.

According to the preferred embodiment, the illuminator 222 has a first terminal connecting with the replaceable battery 221, and a second terminal connecting with the pen holder 10 for electrically connecting with the conductive arm 233 of the driving member 232. When the rotor 231 rotates in the clockwise direction, the conductive arm is pushed down to electrically contact with the replaceable battery 221, the electric circuit between the replaceable battery 221 and the illuminator 222 is closed and the illuminator 222 would then be lit up to provide the light effect as mentioned above. According to the preferred embodiment, the conductive arm 233 which is electrically connected with the pen holder 10 is arranged to electrically contact with the replaceable battery 221 such that the electric circuit is completed.

Conversely, when the rotor 231 rotates in counter-clockwise direction, the pushing arm 234, even contacting the replaceable battery 221, would definitely leave the electric circuit open and therefore, the pen core 21 would be pushed out the bottom opening 13 of the pen holder 10 without the illuminator 222 being lit up.

Referring to FIG. 1 of the drawings, in order to further enhance the strength and durability of the present invention, the writer device 20 further comprises a battery housing 24 embedding an upper portion of the pen core 21 to receive the replaceable battery 221, and a conductive ring 223 coaxially mounted on the battery housing 24 to electrically connect the second terminal of the illuminator 221 with the pen holder 10. In turn, the conductive ring 223 is electrically communicated with the pen holder 10 for closing the electric circuit between the replaceable battery 221 and the illuminator 222.

Furthermore, the writer device 20 further comprises a resilient member 25 mounted within the receiving cavity 11 for normally exerting an upward pulling force to the pen core 21 in such a manner that when the downward pushing force from the driving member 232 is relieved, the pen core 21 would be normally pulled back to receive into the receiving cavity 11 via the bottom opening 13. Accordingly, the resilient member 25, which is embodied as a compression spring, is coaxially mount to the pen core 21 to push the pen core 21 back to the unemployed position from the operation position, wherein the resilient member 25 also functions as a conductive element to electrically connect the conductive ring 223 with the pen holder 10 such that when the conductive arm 233 is pushed downwardly to contact with the replaceable battery 221, the replaceable battery 221 is electrically connected with the illuminator 222 to form a closed circuit.

The light transmissible body 12 is embodied as being made of transparent material, such as plastic materials, provided at a lower portion of the pen holder 10 wherein the receiving cavity 11 is adapted to optically communicate with an exterior of the pen holder 10 via the light transmissible body 12. Accordingly, the illuminator 222 is mounted in the receiving cavity 11 at a position where it is capable of optically communicating with the light transmissible body 12.

In order to further enhance the comfort of the present invention, the preferred embodiment provides that the pen holder 10 further comprises a cushion pad 14 which is made of flexible or soft materials and encircled the light transmissible body 12 such that illumination from the illuminator 222 may still pass through the cushion pad 14 which also substantially relieves a discomfort to the user which may be caused by too hard of the pen holder 10.

From the forgoing descriptions, it can be seen that the above-mentioned objects can be substantially fulfilled. A user is able to conveniently and accurately switch the pen with or without illumination by selectively rotating the rotor 231 in a predetermined direction.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An illumination pen, comprising:

a hollow pen holder having a receiving cavity, a lower light transmissible body, and a bottom opening communicating said receiving opening;

a writer device, which comprises:

a pen core, having a writing tip, disposed in said receiving cavity of said pen holder;

an illumination device comprising a replaceable battery supported in said receiving cavity and at least an illuminator mounted in said receiving cavity; and an actuator, which comprises:

a rotor rotatably provided on said pen holder; and a driving member, which comprises a conductive arm and a pushing arm, being driven by said rotor to move said pen core from a normal unemployed position to an operation position, wherein at said operation position, said rotor is rotated to drive said driving member to push said writing tip out of said pen holder at said bottom opening thereof, and at said unemployed position, said writing tip of said pen core is retracted in said receiving cavity;

wherein said conductive arm functions as a switch and is arranged in such a manner that when said rotor is rotated at a clockwise direction from said unemployed position to move said driving member downwardly, said conductive arm is driven to electrically connect with said illuminator, such that said illuminator generates a light effect within said light transmissible body to an exterior thereof, so as to move said writing tip of said pen core out of said bottom opening of said pen holder;

wherein when said rotor is rotated at a counter-clockwise direction from said unemployed position to move said driving member downwardly, said pushing arm is driven towards said illuminator to move said writing tip of said pen core out of said bottom opening of said pen holder.

2. The illumination pen, as recited in claim 1, wherein said rotor has a guiding ridge formed on an inner side thereof at a position between said conductive arm and said pushing arm, wherein said guiding ridge is selectively engaged with one of said conductive arm and said pushing arm when said rotor is rotated, so as to drive one of said conductive arm and said pushing arm downwardly to driven to move said writing tip of said pen core out of said bottom opening of said pen holder.

3. The illumination pen, as recited in claim 2, wherein said driving member further comprises a supporting member which is rotatably supported within said pen holder and is driven to be rotated by said rotor, wherein said conductive arm and said pushing arm are slidably mounted on two sides of said supporting member such that when said rotor is rotated, said guiding ridge guides one of said conductive arm and said pushing arm downwardly and linearly along said supporting member so as to drive said pen core to move between said normal unemployed position and said operation position.

4. The illumination pen, as recited in claim 3, wherein said conductive arm and said pushing arm have first and second slanted tracks inclinedly and peripherally formed thereon respectively to communicate with a bottom end of said guiding ridge of said rotor, in such a manner that when said rotor is rotated in said clockwise direction, said guiding edge is rotated to slidably engage with and travel along said first slanted track so as to push said conductive arm downwardly for pushing said pen core, and when said rotor is rotated in said counter-clockwise direction, said guiding ridge is rotated to slidably engage with and travel along said second slanted track so as to push said pushing arm downwardly for pushing said pen core.

5. The illumination pen, as recited in claim 4, wherein said driving member further has two retaining stoppers formed on top ends of first and second slanted tracks respectively, wherein when said rotor is rotated, said bottom end of said guiding ridge travels along upward of one of said slanted tracks to eventually engage with one of said retaining stoppers so as to retain said respective conductive arm and said pushing arm in a downwardly moving manner.

6. The illumination pen, as recited in claim 5, wherein said replaceable battery is supported within said receiving cavity of said pen holder at a position between said pen core and said driving member such that when said conductive arm is driven downwardly, a bottom end of said conductive arm is electrically contacted with said replaceable battery so as to electrically connect said replaceable battery with said illuminator and to push said pen core to said operation position, and when said pushing arm which is made of insulating material is driven downwardly, a bottom end of said pushing arm contacts with said replaceable battery to push said pen core to said operation position.

7. The illumination pen, as recited in claim 6, wherein said illuminator has a first terminal electrically connecting with said replaceable battery and a second terminal connecting with said pen holder to electrically connect with said conductive arm of said driving member in such a manner that when said rotor rotates in said clock-wise direction, said conductive arm is pushed downwardly to electrically connect with said replaceable battery so as to complete an electric circuit between said illuminator and said rechargeable battery.

8. The illumination pen, as recited in claim 5, wherein said writer device further comprises a resilient member mounted within said receiving cavity for normally exerting an upward pulling force to said pen core in such a manner that when said downward pushing force from said driving member is relieved, said writing tip of said pen core is pulled back to receive in said receiving cavity via said bottom opening.

9. The illumination pen, as recited in claim 4, wherein said replaceable battery is supported within said receiving cavity of said pen holder at a position between said pen core and said driving member such that when said conductive arm is driven downwardly, a bottom end of said conductive arm is electrically contacted with said replaceable battery so as to electrically connect said replaceable battery with said illuminator and to push said pen core to said operation position, and when said pushing arm which is made of insulating material is driven downwardly, a bottom end of said pushing arm contacts with said replaceable battery to push said pen core to said operation position.

10. The illumination pen, as recited in claim 4, wherein said illuminator has a first terminal electrically connecting with said replaceable battery and a second terminal connecting with said pen holder to electrically connect with said conductive arm of said driving member in such a manner that when said rotor rotates in said clock-wise direction, said conductive arm is pushed downwardly to electrically connect with said replaceable battery so as to complete an electric circuit between said illuminator and said rechargeable battery.

11. The illumination pen, as recited in claim 10, wherein said writer device further comprises a battery housing embedding an upper portion of said pen core to receive said replaceable battery, and a conductive ring mounted on said battery housing to electrically connect said second terminal of said illuminator with said pen holder.

12. The illumination pen, as recited in claim 2, wherein said conductive arm and said pushing arm have first and second slanted tracks inclinedly and peripherally formed thereon respectively to communicate with a bottom end of said guiding ridge of said rotor, in such a manner that when said rotor is rotated in said clockwise direction, said guiding edge is rotated to slidably engage with and travel along said first slanted track so as to push said conductive arm downwardly for pushing said pen core, and when said rotor is rotated in said counter-clockwise direction, said guiding ridge is rotated to slidably engage with and travel along said second slanted track so as to push said pushing arm downwardly for pushing said pen core.

13. The illumination pen, as recited in claim 12, wherein said driving member further has two retaining stoppers formed on top ends of first and second slanted tracks respectively, wherein when said rotor is rotated, said bottom end of said guiding ridge travels along upward of one of said slanted tracks to eventually engage with one of said retaining stoppers so as to retain said respective conductive arm and said pushing arm in a downwardly moving manner.

14. The illumination pen, as recited in claim 1, wherein said replaceable battery is supported within said receiving cavity of said pen holder at a position between said pen core and said driving member such that when said conductive arm is driven downwardly, a bottom end of said conductive arm is electrically contacted with said replaceable battery so as to electrically connect said replaceable battery with said illuminator and to push said pen core to said operation position, and when said pushing arm which is made of insulating material is driven downwardly, a bottom end of said pushing arm contacts with said replaceable battery to push said pen core to said operation position.

15. The illumination pen, as recited in claim 1, wherein said illuminator has a first terminal electrically connecting with said replaceable battery and a second terminal connecting with said pen holder to electrically connect with said conductive arm of said driving member in such a manner that when said rotor rotates in said clock-wise direction, said conductive arm is pushed downwardly to electrically connect with said replaceable battery so as to complete an electric circuit between said illuminator and said rechargeable battery.

16. The illumination pen, as recited in claim 15, wherein said writer device further comprises a battery housing embedding an upper portion of said pen core to receive said replaceable battery, and a conductive ring mounted on said battery housing to electrically connect said second terminal of said illuminator with said pen holder.

17. The illumination pen, as recited in claim 16, wherein said writer device further comprises a battery housing embedding an upper portion of said pen core to receive said replaceable battery, and a conductive ring mounted on said battery housing to electrically connect said second terminal of said illuminator with said pen holder.

18. The illumination pen, as recited in claim 17, wherein said writer device further comprises a resilient member mounted within said receiving cavity for normally exerting an upward pulling force to said pen core in such a manner that when said downward pushing force from said driving member is relieved, said writing tip of said pen core is pulled back to receive in said receiving cavity via said bottom opening.

19. The illumination pen, as recited in claim 18, wherein said driving member further comprises two resilient elements respectively mounted on said conductive arm and said pushing arm for normally exerting an upward pushing force to said conductive arm and said pushing arm respectively so as to normally disengage said conductive arm and said pushing arm with said pen core.

20. The illumination pen, as recited in claim 1, wherein said driving member further comprises two resilient elements respectively mounted on said conductive arm and said pushing arm for normally exerting an upward pushing force to said conductive arm and said pushing arm respectively so as to normally disengage said conductive arm and said pushing arm with said pen core.

* * * * *